US010927678B2

(12) United States Patent
Lee et al.

(10) Patent No.: US 10,927,678 B2
(45) Date of Patent: Feb. 23, 2021

(54) TURBINE VANE HAVING IMPROVED FLEXIBILITY

(71) Applicant: DOOSAN HEAVY INDUSTRIES & CONSTRUCTION CO., LTD., Changwon-si (KR)

(72) Inventors: Mu Hyoung Lee, Changwon-si (KR); Sung Chul Jung, Daejeon (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 52 days.

(21) Appl. No.: 16/355,749

(22) Filed: Mar. 17, 2019

(65) Prior Publication Data

US 2019/0309630 A1 Oct. 10, 2019

(30) Foreign Application Priority Data

Apr. 9, 2018 (KR) ..... 10-2018-0040779

(51) Int. Cl.
*F01D 5/14* (2006.01)
*F01D 5/18* (2006.01)
(Continued)

(52) U.S. Cl.
CPC ..... *F01D 5/147* (2013.01); *F01D 5/186* (2013.01); *F01D 9/041* (2013.01); *F01D 9/065* (2013.01);
(Continued)

(58) Field of Classification Search
CPC . F01D 1/04; F01D 5/143; F01D 5/147; F01D 5/186; F01D 9/041; F01D 9/065;
(Continued)

(56) References Cited

U.S. PATENT DOCUMENTS 6,752,594 B2 * 6/2004 Miller ..... F01D 5/16 416/1
6,951,447 B2 * 10/2005 Cherolis ..... F01D 5/141 416/193 A
(Continued)

FOREIGN PATENT DOCUMENTS

JP 363248902 A * 4/1987 ..... F01D 11/18
JP 2000130103 A 5/2000
(Continued)

OTHER PUBLICATIONS

A Korean Office Action dated May 7, 2019 in connection with Korean Patent Application No. 10-2018-0040779 which corresponds to the above-referenced U.S. application.
(Continued)

*Primary Examiner* — Igor Kershteyn
(74) *Attorney, Agent, or Firm* — Invenstone Patent, LLC

(57) ABSTRACT

Disclosed is a turbine vane having an airfoil in a cross section including a leading edge, a trailing edge, and a pressure surface and a suction surface connecting the leading edge and the trailing edge, the airfoil extending radially from a platform part to an end wall, wherein the trailing edge of the airfoil is provided with a cutback cut in a direction radially perpendicular to both the pressure surface and the suction surface.

12 Claims, 6 Drawing Sheets

(51) Int. Cl.
*F01D 9/04* (2006.01)
*F01D 9/06* (2006.01)

(52) U.S. Cl.
CPC .... *F05D 2220/32* (2013.01); *F05D 2240/122* (2013.01); *F05D 2260/202* (2013.01)

(58) Field of Classification Search
CPC ..... F01D 11/08; F05D 2220/32; F05D 2240/122; F05D 2240/80; F05D 1160/202; F05D 1160/941
See application file for complete search history.

(56) References Cited

U.S. PATENT DOCUMENTS 7,160,084 B2 * 1/2007 Ahmad ..... F01D 5/143 416/231 B
7,416,394 B2 * 8/2008 Ahmad ..... F01D 5/147 416/231 B
7,736,128 B2 * 6/2010 Huber ..... F03B 3/121 416/186 R
7,775,769 B1 8/2010 Liang
8,556,584 B2 * 10/2013 Mallaiah ..... F01D 5/087 416/185
9,556,749 B2 * 1/2017 Pauli ..... F01D 25/162
2002/0119730 A1 8/2002 Dean et al.
2012/0237350 A1 9/2012 Corcoran et al.
2016/0177760 A1 6/2016 Brandl et al.

FOREIGN PATENT DOCUMENTS

JP 2005-180431 A 7/2005
JP 2013-083251 A 5/2013
KR 10-2008-0037589 A 4/2008
KR 10-2016-0074423 A 6/2016

OTHER PUBLICATIONS

A Korean Office Action dated Jul. 15, 2019 in connection with Korean Patent Application No. 10-2018-0040779 which corresponds to the above-referenced U.S. application.

* cited by examiner

TURBINE VANE HAVING IMPROVED FLEXIBILITY

CROSS REFERENCE TO RELATED APPLICATION

The present application claims priority to Korean Patent Application No. 10-2018-0040779, filed on Apr. 9, 2018, the entire contents of which are incorporated herein for all purposes by this reference.

BACKGROUND OF THE DISCLOSURE

1. Field of the Disclosure

The present disclosure relates to a turbine vane of a gas turbine and, more particularly, to a turbine vane of a gas turbine having increased flexibility to reduce the risk of breakage of a structurally vulnerable trailing edge.

2. Description of the Background Art

The turbine is a mechanical device that obtains a rotational force by an impact force or reaction force using a flow of a compressible fluid such as steam or gas. The turbine includes a steam turbine using a steam and a gas turbine using a high temperature combustion gas.

Among them, the gas turbine is mainly composed of a compressor, a combustor, and a turbine. The compressor is provided with an air inlet for introducing air, and a plurality of compressor vanes and compressor blades, which are alternately arranged in a compressor casing. The air introduced from outside is gradually compressed up to a target pressure through the rotary compressor blades disposed in multiple stages.

The combustor supplies fuel to the compressed air compressed in the compressor and ignites a fuel-air mixture with a burner to produce a high temperature and high-pressure combustion gas.

The turbine has a plurality of turbine vanes and turbine blades disposed alternately in a turbine casing. Further, a rotor is arranged to pass through the center of the compressor, the combustor, the turbine, and an exhaust chamber.

Both ends of the rotor are rotatably supported by bearings. A plurality of disks is fixed to the rotor so that the respective blades are connected and a drive shaft, such as a generator, is connected to an end of the exhaust chamber.

Since these gas turbines have no reciprocating mechanism such as a piston in a 4-stroke engine, so that there are no mutual frictional parts like a piston-cylinder, the gas turbine has advantages in that consumption of lubricating oil is extremely small, amplitude as a characteristic of a reciprocating machine is greatly reduced, and a high-speed operation is possible.

During the operation of the gas turbine, the compressed air in the compressor is mixed with fuel and combusted to produce a high-temperature combustion gas, which is then injected toward the turbine. The injected combustion gas passes through the turbine vanes and the turbine blades to generate a rotational force, which causes the rotor to rotate.

The factors that affect the efficiency of the gas turbine vary widely. The gas turbine has gone through some development in various aspects, such as improvement of combustion efficiency in the combustor, improvement of thermodynamic efficiency through an increase in turbine inlet temperature, and improvement of aerodynamic efficiency in the compressor and the turbine.

The class of the industrial gas turbine for power generation can be classified into the turbine inlet temperature (TIT). Currently, G and H class gas turbines take the leading position. It has been reported that the most recently developed gas turbine reached a class of J. The higher the class of the gas turbine is, the higher the efficiency and the turbine inlet temperature are. In the case of the H class gas turbine, the turbine inlet temperature reaches 1,500° C., which requires development of both heat resistant materials and cooling technology.

SUMMARY OF THE DISCLOSURE

Heat resistant designs are needed throughout the gas turbine, especially in the combustor and the turbine where high temperature combustion gases are generated and flow. The gas turbine is cooled by an air-cooling mechanism using compressed air from the compressor. However, the mechanism is often more difficult to design due to the complex structure of turbine vanes being fixedly arranged between rotating turbine blades over several stages.

In the case of a turbine vane, numerous cooling holes and cooling slots are formed to protect the turbine vane from high temperature thermal stress environments. Particularly in the case of an airfoil of the turbine vane, since stresses are concentrated on a trailing edge, the thinnest portion of the airfoil, there is a high risk of damage in this area. Therefore, a design is required to reduce the risk of breakage of the structurally vulnerable trailing edge in the turbine vane.

The foregoing is intended merely to aid in the understanding of the background of the present disclosure, and is not intended to mean that the present disclosure falls within the purview of the related art that is already known to those skilled in the art.

Accordingly, the present disclosure has been made keeping in mind the above problems occurring in the related art, and an object of the present disclosure is to provide a turbine vane capable of to reducing the risk of stress concentration on and breakage of a trailing edge which is structurally vulnerable due to being the thinnest part area in an airfoil of the turbine vane.

In an aspect of the present disclosure, a turbine vane includes an airfoil in a cross section having a leading edge, a trailing edge, and a pressure surface and a suction surface connecting the leading edge and the trailing edge, the airfoil extending radially from a platform part to an end wall, wherein the trailing edge of the airfoil is provided with a cutback cut in a direction radially perpendicular to both the pressure surface and the suction surface.

The cutback may be located in proximity to the platform part or the end wall, or otherwise in proximity to the platform part and the end wall, respectively.

The cutback may be located at a boundary of a fillet connecting the platform part and the trailing edge of the airfoil or a boundary of a fillet connecting the end wall and the trailing edge of the airfoil.

The cutback may be provided at a distal end thereof with an extended hole wider than a width of the cutback, wherein the extended hole is circular.

The cutbacks may be located at a boundary of a fillet connecting the platform part and the trailing edge of the airfoil and a boundary of a fillet connecting the end wall and the trailing edge of the airfoil, wherein a plurality of cooling slots is formed between the two cutbacks along the trailing edge of the airfoil on the pressure surface side.

The cutback may communicate with a cavity in the airfoil so that a cooling fluid is discharged through the cutback.

According to the turbine vane of the present disclosure having the above-described configuration, the cutbacks are cut in both the pressure surface and the suction surface of the trailing edge in the direction perpendicular to the radial direction to impart flexibility to the trailing edge, thereby effectively delaying cracking from being generated from the trailing edge that is structurally vulnerable.

Further, the cutback may be provided with an extended hole at a distal end thereof, thereby further delaying the propagation of cracking and alleviating the stress concentration more effectively.

The technique of forming the cutbacks in the trailing edge can be advantageously used not only for manufacturing a new turbine vane but also for maintaining the existing turbine vane, thereby increasing the recovering rate of the components.

DETAILED DESCRIPTION OF THE DISCLOSURE

Figure 1:
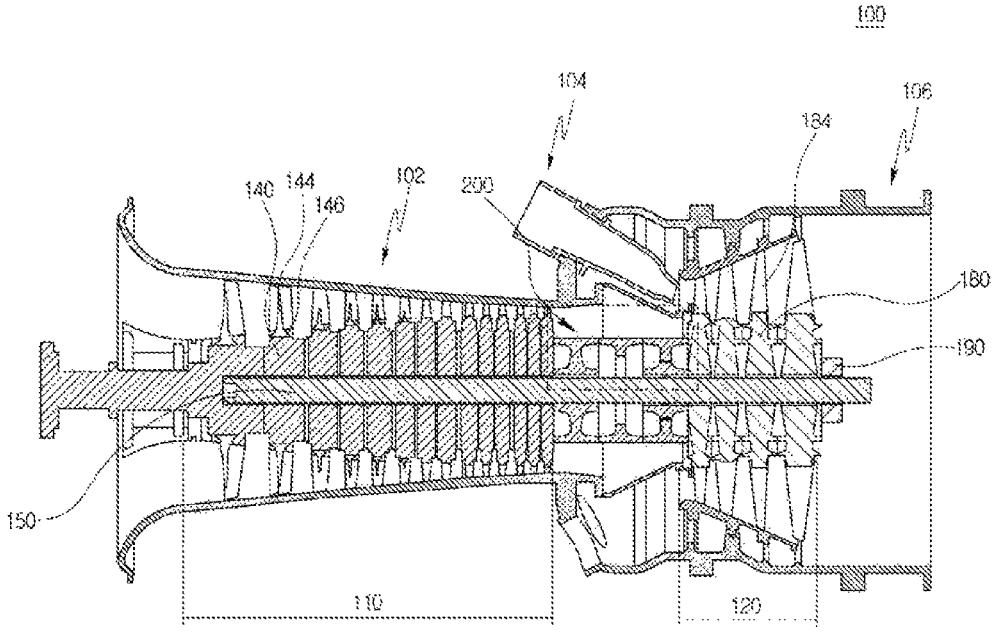
FIG. 1 is a cross-sectional view illustrating a schematic structure of a gas turbine according to an embodiment of the present disclosure.

Hereinafter, exemplary embodiments of the present disclosure will be described in detail with reference to the accompanying drawings. However, it should be noted that the present disclosure is not limited thereto, but may include all of modifications, equivalents or substitutions within the spirit and scope of the present disclosure.

Terms used herein are used to merely describe specific embodiments, and are not intended to limit the present disclosure. As used herein, an element expressed as a singular form includes a plurality of elements, unless the context clearly indicates otherwise. Further, it will be understood that the terms "comprising" or "including" specify the presence of a stated feature, number, step, operation, element, part, or combination thereof, but does not preclude the presence or addition of one or more other features, numbers, steps, operations, elements, parts, or combinations thereof.

Hereinafter, preferred embodiments of the present disclosure will be described in detail with reference to the accompanying drawings. It is noted that like elements are denoted in the drawings by like reference symbols whenever possible. Further, the detailed description of known functions and configurations that may obscure the gist of the present disclosure will be omitted. For the same reason, some of the elements in the drawings are exaggerated, omitted, or schematically illustrated.

Referring to FIG. 1, an example of a gas turbine 100 to which an embodiment of the present disclosure is applied is shown. The gas turbine 100 includes a housing 102 and a diffuser 106 which is disposed on a rear side of the housing 102 and through which a combustion gas passing through a turbine is discharged. A combustor 104 is disposed in front of the diffuser 106 so as to receive and burn a fuel-air mixture.

Referring to the flow direction of the air, a compressor section 110 is located on the upstream side of the housing 102, and a turbine section 120 is located on the downstream side of the housing. A torque tube is disposed as a torque transmission member between the compressor section 110 and the turbine section 120 to transmit the rotational torque generated in the turbine section 120 to the compressor section 110.

The compressor section 110 is provided with a plurality (for example, 14) of compressor rotor disks 140, which are fastened by a tie rod 150 to prevent axial separation thereof.

Specifically, the compressor rotor disks 140 are axially arranged with the tie rod 150 passing through substantially central portion thereof. Here, the neighboring compressor rotor disks 140 are disposed so that opposed surfaces thereof are pressed by the tie rod 150 and the neighboring compressor rotor disks 140 do not rotate relative to each other.

A plurality of blades 144 are radially coupled to an outer circumferential surface of the compressor rotor disks 140. Each of the blades 144 has a root portion 146 which is fastened to a corresponding one of the compressor rotor disks 140.

Vanes (not shown) fixed to the housing are respectively positioned between the rotor disks 140. Unlike the rotor disks 140, the vanes are fixed to the housing and do not rotate. The vanes serve to align a flow of compressed air that has passed through the blades 144 of the compressor rotor disks 140 and guide the air to the blades 144 of the rotor disks 140 located on the downstream side.

The fastening method of the root portion 146 includes a tangential type and an axial type. These may be chosen according to the required structure of the commercial gas turbine, and may have a generally known dovetail or fir-tree shape. In some cases, it is possible to fasten the blades 144 to the rotor disks 140 by using other fasteners, such as keys or bolts, in addition to the fastening shapes.

The tie rod 150 is arranged to pass through the center of the compressor rotor disks 140 such that one end thereof is fastened to one of the compressor rotor disks 140 located on the most upstream side and the other end thereof is fastened to the torque tube.

The shape of the tie rod 150 is not limited to that shown in FIG. 1, but may have a variety of structures depending on the gas turbine. That is, as shown in the drawing, one tie rod may have a shape passing through a central portion of the rotor disks 140, a plurality of tie rods may be arranged in a circumferential manner, or a combination thereof may be used.

Although not shown, the compressor of the gas turbine 100 may be provided with a vane serving as a guide element at the next position of the diffuser 106 in order to adjust a flow angle of a pressurized fluid entering a combustor inlet to a designed flow angle. The vane is referred to as a deswirler.

The combustor 104 mixes the introduced compressed air with fuel and combusts the air-fuel mixture to produce a high-temperature and high-pressure combustion gas. With an isobaric combustion process in the compressor, the temperature of the combustion gas is increased to the heat resistance limit that the combustor 104 and the turbine components can withstand.

The combustor 104 comprises a plurality of combustors, which are arranged in the casing formed in a cell shape, and includes a burner having a fuel injection nozzle and the like, a combustor liner forming a combustion chamber, and a transition piece as a connection between the combustor 104 and the turbine, thereby constituting a combustion system of the gas turbine 100.

Specifically, the combustor liner provides a combustion space in which the fuel injected by the fuel nozzle is mixed with the compressed air of the compressor and the fuel-air mixture is combusted. Such a liner may include a flame canister providing a combustion space in which the fuel-air mixture is combusted, and a flow sleeve forming an annular space surrounding the flame canister. A fuel nozzle is coupled to the front end of the liner, and an igniter is coupled to the side wall of the liner.

On the other hand, the transition piece is connected to a rear end of the liner so as to transmit the combustion gas to the turbine side. An outer wall of the transition piece is cooled by the compressed air supplied from the compressor so as to prevent thermal breakage due to the high temperature combustion gas.

To this end, the transition piece is provided with cooling holes through which compressed air is injected into and cools the inside of the transition piece and flows towards the liner.

The air that has cooled the transition piece flows into the annular space of the liner, and the compressed air is supplied as a cooling air to the outer wall of the liner from the outside of the flow sleeve through cooling holes provided in the flow sleeve so that both air flows may collide with each other.

In the meantime, the high-temperature and high-pressure combustion gas from the combustor 104 is supplied to the turbine section 120. The supplied high-temperature and high-pressure combustion gas expands and collides with and provides a reaction force to rotating blades of the turbine to cause a rotational torque, which is then transmitted to the compressor section 110 through the torque tube. Here, an excess of power required to drive the compressor is used to drive a generator or the like.

The turbine section 120 is fundamentally similar in structure to the compressor section 110. That is, the turbine section 120 is also provided with a plurality of turbine rotor disks 180 similar to the compressor rotor disks 140 of the compressor section 110. Thus, the turbine rotor disk 180 also includes a plurality of turbine blades 184 disposed radially. The turbine blade 184 may also be coupled to the turbine rotor disk 180 in a dovetail coupling manner, for example. Between the blades 184 of the turbine rotor disk 180, a vane (not shown) fixed to the housing is provided to induce a flow direction of the combustion gas passing through the blades 184.

Figure 2:
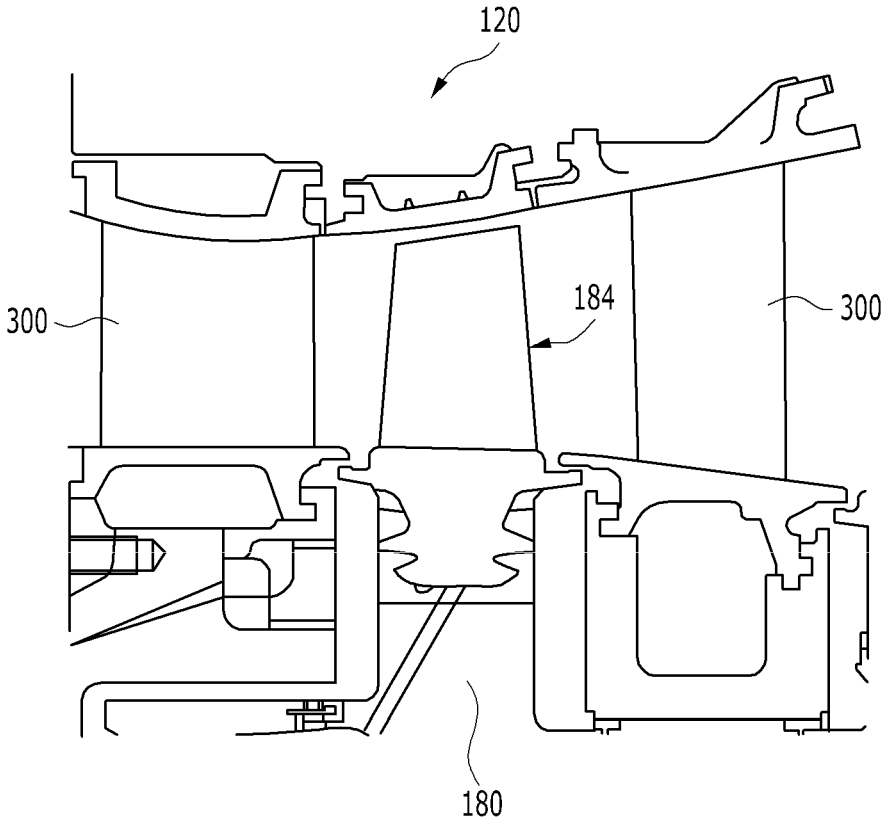
FIG. 2 is a cross-sectional view of an internal portion of a turbine in the gas turbine of FIG. 1.

FIG. 2 is a view showing the internal structure of the turbine section 120 in more detail. In the turbine section, turbine vanes 300 and turbine blades 184 are alternately disposed in a direction from the turbine inlet to the outlet. Similar to the compressor section 110, the turbine blade 184 has a dovetail or fir-tree type root part fastened to the slot of the turbine disk 180 secured to the turbine rotor so that when the turbine blade 184 rotates with the high-pressure combustion gas flow, the turbine rotor rotates to generate power. The turbine vane 300 positioned on the upstream side of the turbine blade 184 is fixedly installed along the circumferential direction of the inner surface of the housing, and the turbine vane 300 guides the flow direction of the combustion gas flowing to the turbine blade 184 appropriately so that the aerodynamic performance of the turbine blades 184 is optimized.

The turbine section 120 differs from the compressor section 110 in that the cooling of turbine components, particularly turbine vane 300 and turbine blade 184, is important because the turbine section 120 is a region where hot combustion gases flow. Thus, a hollow portion through which the compressed air flows is formed inside the turbine vane 300 and the turbine blade 184, and collision cooling and film cooling are performed by injecting the compressed air therein through cooling holes formed on the surface of the turbine vane 300 and the turbine blade 184.

Another difference in the turbine section 120 is that a sealing structure is also needed to prevent the combustion gas from leaking through a gap between the turbine vane 300 and the turbine blade 184. A sealing structure is thus applied between a platform part of the turbine vane 300 fixed to the inner surface of the housing, and a sealing structure is also applied between an end wall of the turbine vane 300 (opposite the platform part) and the platform part of the turbine vane 300. The platform part may also be referred to as an outer shroud, and the end wall may be referred to as an inner shroud.

Figure 3:
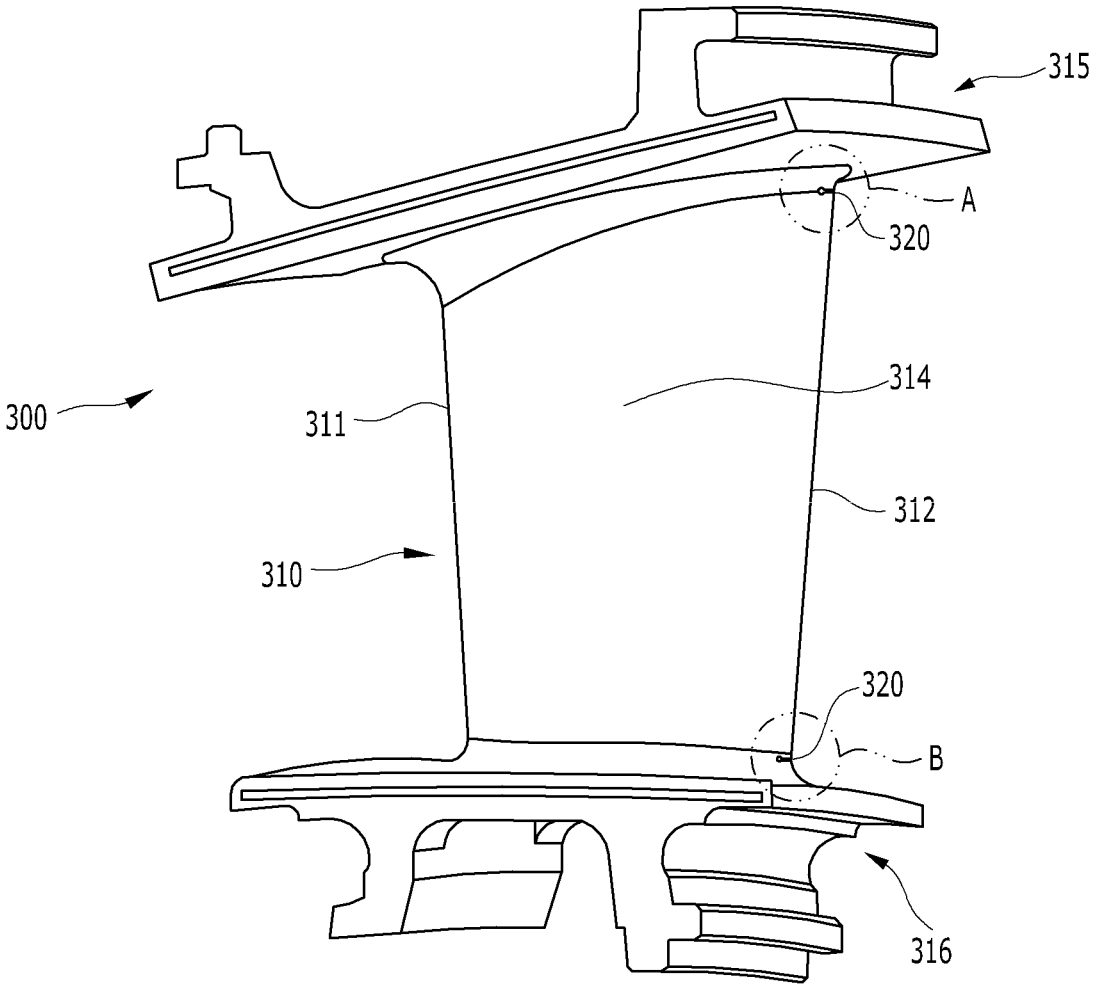
FIG. 3 is a view illustrating a turbine vane according to an embodiment of the present disclosure.

Referring to FIG. 3, the turbine vane 300 includes an airfoil 310 in a cross section with a leading edge 311, a trailing edge 312, and a pressure surface 313 (See FIG. 6) and a suction surface 314 connecting the leading edge 311 and the trailing edge 312. The airfoil 310 extends radially from the platform part 315 to the end wall 316. The combustion gas enters the leading edge 311 and branches into sub-flows while flowing through the pressure surface 313 and the suction surface 314, and then joins at the trailing edge 312 and flows to the downstream side turbine blades 184.

The turbine vane 300 exposed to the combustion gas is placed in a high-temperature and high-pressure environment. The thermal stress at high temperature weakens the rigidity of the turbine vane 300, and the high pressure of the combustion gas itself and the lift applied onto the suction surface 314 from the pressure surface 313 of the airfoil 310 continuously act on the turbine vane 300 as a deforming load.

Particularly, the most structurally weak part of the turbine vane 300 is the trailing edge 312. Compared to the platform part 315 and the end wall 316 of the turbine vane 300, the airfoil 310 is vulnerable to external forces because the airfoil 310 is almost hollow and extends in the radial direction. Particularly, since the trailing edge 312 of the airfoil 310 has the thinnest part of the airfoil structure, the stiffness of the trailing edge 312 is much lower than that of the other portions. Since the trailing edge 312 is located downstream of the combustion gas, the force acting on the leading edge 311 is amplified at and applied on the trailing edge 312, so that cracking due to the fatigue failure of the turbine vane 300 is mainly found at the trailing edge 312.

Therefore, there is a need to provide a way to mitigate the stress concentration on the trailing edge 312 of the turbine vane 300, and the main configuration of the present disclosure is shown in FIG. 3.

The turbine vane 300 shown in FIG. 3 has cutbacks 320 which are cut in the trailing edge 312 of the airfoil 310 such that the cutbacks are provided in both the pressure surface 313 and the suction surface 314 along a direction perpendicular to the radial direction. That is, the cutbacks 320 are formed in the trailing edge 312 to cut portions of the airfoil 310 laterally.

The cutout groove of the cutback 320 provided in the trailing edge 312 imparts flexibility to the trailing edge 312 of the airfoil 310. In other words, by cutting a portion of the continuously connected trailing edge 312 by an amount so as not to significantly weaken the strength of the trailing edge 312, the trailing edge 312 can have an ability to move smoothly with respect to the cutback 320 without causing deformation thereto when applied with an external force. The cutbacks 320 cut in both the pressure surface 313 and the suction surface 314 of the trailing edge 312 in the direction perpendicular to the radial direction reduce the stress concentration on the trailing edge 312. As described above, since the trailing edge 312 is the weakest portion, the stress concentration relaxation due to the formation of the cutbacks 320 greatly contributes to an improvement in the service life of the turbine vane 300.

Figure 4:
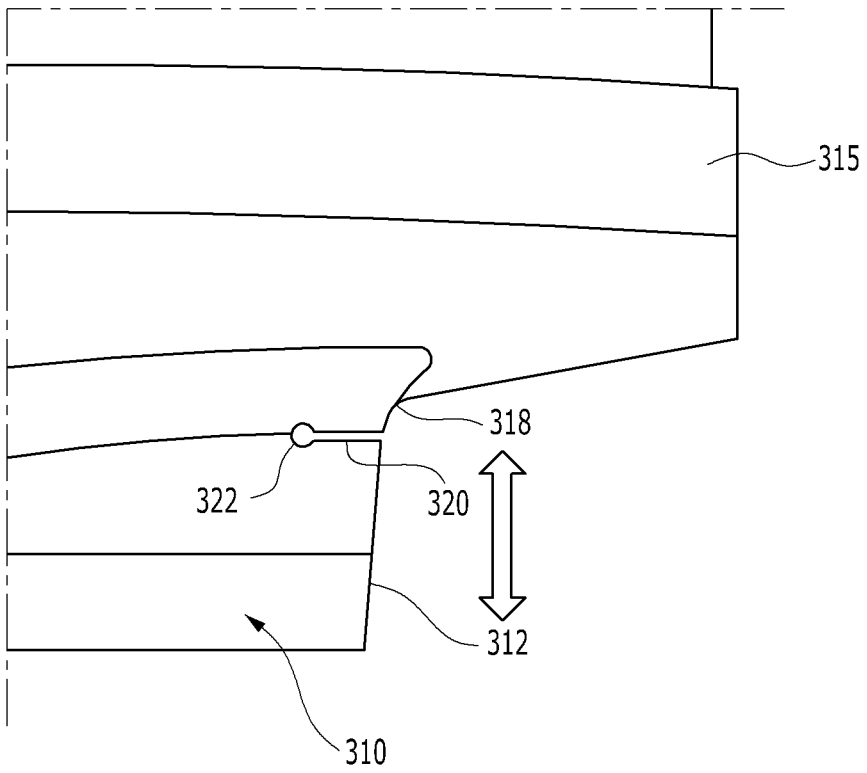
FIG. 4 is an enlarged view of a portion A in FIG. 3.
Figure 5:
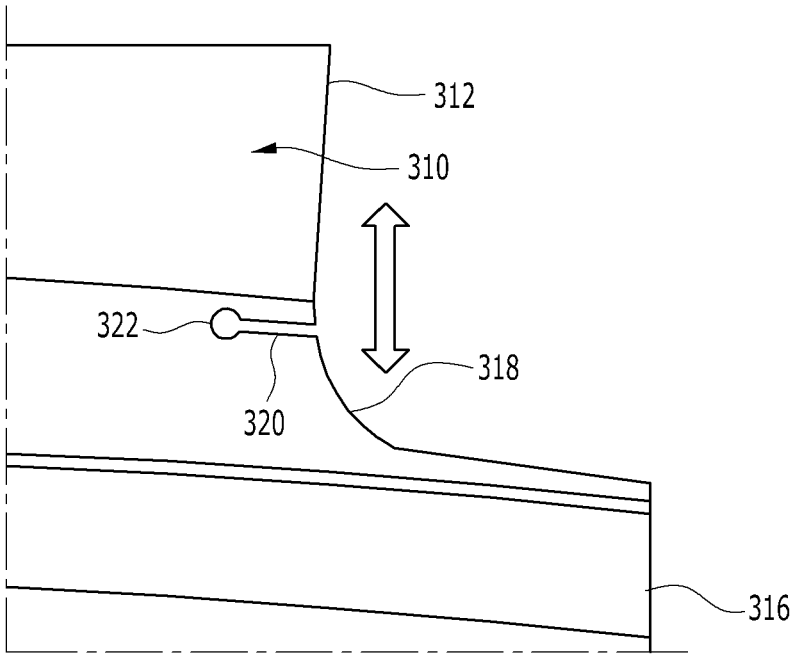
FIG. 5 is an enlarged view of a portion B in FIG. 3.

The formation of the cutbacks 320 in the trailing edge 312 may be implemented in various forms. Referring to FIGS. 4 and 5, in terms of providing the trailing edge 312 with as much flexibility as possible, the cutbacks 320 may preferably be disposed in the region in proximity to the platform part 315 or the end wall 316 of the turbine vane 300. In the structure of the turbine vane 300, the platform part 315 and the end wall 316 have sufficiently high rigidity so that when the cutbacks 320 are formed in proximity to the platform part 315 and the end wall 316, the trailing edge 312, which has a low rigidity relative to the platform part 315 and the end wall 316, can move smoothly.

The cutbacks 320 in the trailing edge 312 may be formed only in either the platform part 315 or the end wall 316, or in both the platform part 315 and the end wall 316 depending on the manner in which stress is applied to the turbine vane 300. Since the turbine vanes 300 are circumferentially arranged on the inner circumferential surface of the turbine section 120 and sealing members are coupled to the end walls 316 corresponding to the free ends of the turbine vanes 300, the distribution of the stress acting on the trailing edges 312 varies depending on the circumferential position of the turbine vanes 300.

In view of this, it is possible to form the cutback 320 only in either the platform part 315 or the end wall 316 according to the stress distribution in each turbine vane 300. However, this configuration in which the stress distribution of each turbine vane 300 is respectively calculated and the cutbacks 320 are optimally formed according to the calculated stress distribution has a problem in that it is not cost effective and requires careful attention to component management and assembly. Thus, it is practically useful to form the cutbacks 320 on both sides of the platform part 315 and the end wall 316

In order to form the cutbacks 320 to further effectively alleviate the concentration of stress acting on the trailing edge 312, the cutbacks 320 may preferably be formed at a boundary of a fillet 318 connecting the platform part 315 and the trailing edge 312 of the airfoil 310, and a boundary of a fillet 318 connecting the end wall 316 and the trailing edge 312 of the airfoil 310. The fillets 318 may be formed in a gentle curve on portions connecting the airfoil 310 to the platform part 315 and the end wall 316 to distribute the stress applied thereto. In this case, the stress is well distributed in the fillets 318, but the stress is relatively concentrated on the boundary between the curved fillet 318 and the straight trailing edge 312. Thus, as illustrated in FIGS. 4 and 5, when the cutback 320 is formed at the boundary between the fillet 318 and the trailing edge 312, the cracking due to the fatigue fracture can be effectively prevented.

Further, the end of the cutback 320 in the trailing edge 312 may be further processed to form an extended hole 322 that is wider than the width of the cutback 320. The extended hole 322 at the end of the cutback 320 serves to delay the cracking from occurring and progressing along the cutback 320. The extended hole 322 of the cutback 320 is preferably circular, which delays progressing of cracking more effectively by uniformly distributing the stress concentrated on the end of the cutback 320 in all directions.

The technique of forming the cutbacks 320 in the trailing edge 312 of the present disclosure as described above can be advantageously used not only for manufacturing a new turbine vane 300 but also for maintaining the existing turbine vane 300. That is, since forming the cutbacks 320 by cutting off the trailing edge 312 of the turbine vane 300 is very easy, and it is not necessary to add any additional parts or design changes, the present disclosure can be applied to the maintenance and repair states so as to increase the component regeneration rate.

Figure 6:
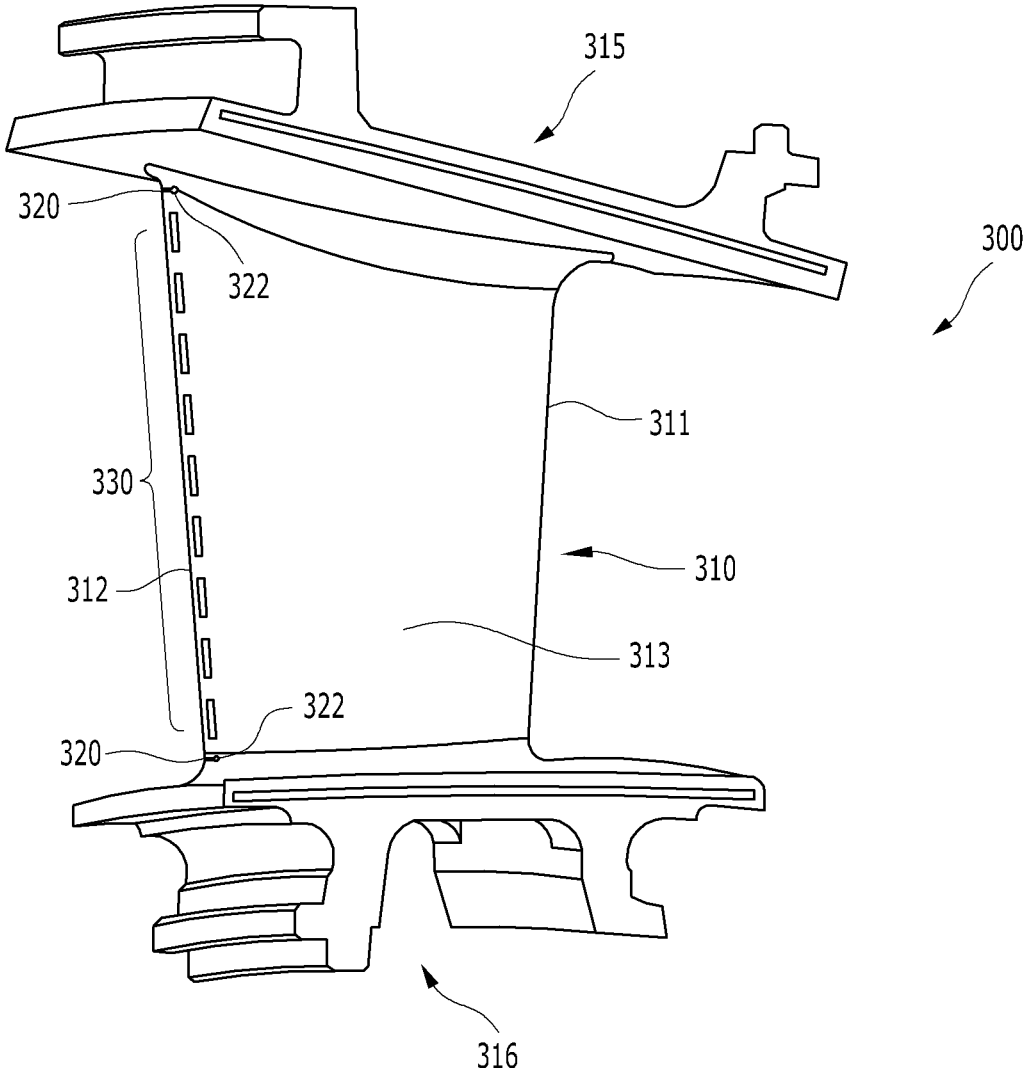
FIG. 6 is a view of the turbine vane of FIG. 3 viewed from a pressure side thereof.

FIG. 6 shows an embodiment in which a plurality of cooling slots 330 is formed along the pressure side 313 of the trailing edge 312 of the turbine vane 300 to allow a cooling fluid to be discharged therethrough. In this case, since the cooling slots 330 are disposed between the cutbacks 320 formed in proximity to the platform part 315 and the end wall 316, respectively, the cooling slots 330 can be prevented from being highly stress-concentrated. In other words, the cutbacks 320 at both ends bear a large part of the stress, so that the cooling slots 330 therebetween can be protected from stress.

Further since the cutbacks 320 are cut so as to communicate with the cavity inside the airfoil 310 to allow the cooling fluid to be discharged through the cutbacks 320, the cutbacks 320 themselves are sufficiently cooled, thereby improving the durability so that the function of the cutbacks 320 can be maintained longer.

While the embodiments of the present disclosure have been described, it will be apparent to those skilled in the art that various modifications and variations can be made in the present disclosure through addition, change, omission, or substitution of components without departing from the spirit of the disclosure as set forth in the appended claims. For example, the present disclosure may also be applied to the case where turbine blades other than compressor blades are coupled in a dovetail joint manner, and such modifications and changes may also be included within the scope of the present disclosure.

The invention claimed is:

1. A turbine vane including an airfoil in a cross section, the airfoil comprising:

a leading edge, a trailing edge, and a pressure surface and a suction surface connecting the leading edge and the trailing edge, the airfoil extending radially from a platform part of the turbine vane to an end wall of the turbine vane, wherein the trailing edge of the airfoil is provided with one or more cutbacks in a direction radially perpendicular to both the pressure surface and the suction surface, wherein a first cutback is located in proximity to the platform part of the turbine vane, wherein a second cutback is located in proximity to the end wall of the turbine vane, wherein the first cutback is located at a boundary of a fillet connecting the platform part of the turbine vane and the trailing edge of the airfoil, and wherein the second cutback is located at a boundary of a fillet connecting the end wall of the turbine vane and the trailing edge of the airfoil.

2. The turbine vane of claim 1, wherein the first cutback or the second cutback is provided at a distal end thereof with an extended hole wider than a width of the first cutback or the second cutback.

3. The turbine vane of claim 1, further comprising:

a plurality of cooling slots formed between the first cutback or the second cutback and at least one additional cutback formed along the trailing edge of the airfoil on the pressure surface side.

4. The turbine vane of claim 2, wherein the first cutback or the second cutback communicates with a cavity in the airfoil so that a cooling fluid is discharged through the first cutback or the second cutback.

5. A turbine vane assembly, comprising:

a plurality of turbine vanes circumferentially coupled to an inner circumferential surface of a turbine housing, each turbine vane comprising an airfoil in a cross section including a leading edge, a trailing edge, and a pressure surface and a suction surface connecting the leading edge and the trailing edge, the airfoil extending radially from a platform part of the each turbine vane to an end wall of the each turbine vane, wherein the trailing edge of the airfoil is provided with one or more cutbacks in a direction radially perpendicular to both the pressure surface and the suction surface, wherein a first cutback is located in proximity to the platform part of the turbine vane, wherein a second cutback is located in proximity to the end wall of the turbine vane, wherein the first cutback is located at a boundary of a fillet connecting the platform part of the turbine vane and the trailing edge of the airfoil, and wherein the second cutback is located at a boundary of a fillet connecting the end wall of the turbine vane and the trailing edge of the airfoil.

6. The turbine vane assembly of claim 5, wherein the first cutback or the second cutback is provided at a distal end thereof with an extended circular hole wider than a width of the first cutback or the second cutback.

7. The turbine vane assembly of claim 6, further comprising:

a plurality of cooling slots formed between the first cutback or the second cutback and at least one additional cutback formed along the trailing edge of the airfoil on the pressure surface side.

8. The turbine vane assembly of claim 6, wherein the first cutback or the second cutback communicates with a cavity in the airfoil so that a cooling fluid is discharged through the first cutback or the second cutback.

9. A gas turbine, comprising:

a combustor mixing fuel with compressed air to provide a fuel-air mixture and combusting the fuel-air mixture to generate an expanding high-temperature combustion gas; and a turbine receiving the combustion gas generated in the combustor and converting a reaction force of the combustion gas to a rotary motion of a turbine blade, wherein the turbine comprises a plurality of turbine vanes guiding a flow of the combustion gas flowing to the turbine blade, each turbine vane having an airfoil in a cross section including a leading edge, a trailing edge, and a pressure surface and a suction surface connecting the leading edge and the trailing edge, the airfoil extending radially from a platform part of the each turbine vane to an end wall of the each turbine vane, wherein the trailing edge of the airfoil is provided with one or more cutbacks in a direction radially perpendicular to both the pressure surface and the suction surface, wherein a first cutback is located in proximity to the platform part of the turbine vane, wherein a second cutback is located in proximity to the end wall of the turbine vane, wherein the first cutback is located at a boundary of a fillet connecting the platform part of the turbine vane and the trailing edge of the airfoil, and wherein the second cutback is located at a boundary of a fillet connecting the end wall of the turbine vane and the trailing edge of the airfoil.

10. The gas turbine of claim 9, wherein the first cutback or the second cutback is provided at a distal end thereof with an extended circular hole wider than a width of the first cutback or the second cutback.

11. The gas turbine of claim 9, further comprising:

a plurality of cooling slots formed between the first cutback or the second cutback and at least one additional cutback formed along the trailing edge of the airfoil on the pressure surface side.

12. The gas turbine of claim 10, wherein the first cutback or the second cutback communicates with a cavity in the airfoil so that a cooling fluid is discharged through the first cutback or the second cutback.

* * * * *